US006487999B2

(12) United States Patent
Ha

(10) Patent No.: US 6,487,999 B2
(45) Date of Patent: Dec. 3, 2002

(54) LINER MOUNTING STRUCTURE FOR MEASURING PISTON FRICTION

(75) Inventor: Kyoung-Pyo Ha, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/994,028

(22) Filed: Nov. 20, 2001

(65) Prior Publication Data

US 2002/0083913 A1 Jul. 4, 2002

(30) Foreign Application Priority Data

Dec. 28, 2000 (KR) ..... 2000-83915

(51) Int. Cl.[7] ..... F02F 1/14
(52) U.S. Cl. ..... 123/193.2
(58) Field of Search ..... 123/193.2, 668

(56) References Cited

U.S. PATENT DOCUMENTS 4,841,928 A * 6/1989 Paul et al. ..... 123/668
5,402,754 A * 4/1995 Gunnarsson ..... 123/193.2
5,957,103 A * 9/1999 Takami et al. ..... 123/193.2

* cited by examiner

*Primary Examiner*—Marguerite McMahon
(74) *Attorney, Agent, or Firm*—Christie, Parker & Hale, LLP

(57) ABSTRACT

A liner mounting structure for measuring piston friction in which a liner is mounted in a cylinder block of an internal combustion engine and is cylindrically shaped to define a space in which a piston undergoes rectilinear motion. A protrusion is formed around an outer circumference of the liner at an upper portion of the liner. A combustion pressure passageway formed in the liner starting from an upper surface of the liner and extending downwardly to a bottom surface of the protrusion. An indentation is formed in the cylinder block corresponding to a position of the protrusion of the liner. An upper O-ring groove formed in the cylinder block above the indentation. A lower O-ring groove is formed in the cylinder block below the indentation, and a center O-ring groove is formed in the cylinder block within the indentation. An upper O-ring is mounted in the upper O-ring groove, a lower O-ring mounted in the lower O-ring groove, and a center O-ring is mounted in the center O-ring groove.

10 Claims, 4 Drawing Sheets

LINER MOUNTING STRUCTURE FOR MEASURING PISTON FRICTION

CROSS-REFERENCE TO RELATED APPLICATION

This application claims priority of Korea patent Application No. 2000-83915, filed on Dec. 28, 2000.

BACKGROUND OF THE INVENTION (a) Field of the Invention

The present invention relates to a liner mounting structure for measuring piston friction, and more particularly, to a liner mounting structure for measuring piston friction in which the influence of combustion pressure acting on a liner is removed, and floating of the liner is made easy.

(b) Description of the Related Art

In an internal combustion engine, the energy created by the combustion of fuel in a combustion chamber, less the energy lost due to dissipative forces, is used in propelling a vehicle. Since piston friction is one of the major sources of energy dissipation, it is necessary to reduce the energy lost in this manner so that engine power may be increased and fuel consumption reduced.

That is, friction generated between the piston and cylinder liner is not only one of the major sources of dissipation, it is a source of dissipation that can be reduced by better design, whereas many of the other sources may only be reduced minimally if at all and only with limited gains in performance. Therefore, much research has gone into reducing piston friction, as well as into ways to more precisely measure the friction generated between the piston and cylinder liner.

In order to directly measure the friction between the piston and cylinder liner, a strain gauge or load cell is used to measure the force generated by the vertical displacement of the cylinder liner occurring as a result of friction with the piston.

FIG. 1 shows an example of a conventional apparatus and related elements used to measure friction between a piston and a cylinder liner.

As shown in the drawing, a cylinder liner 120 is provided within a cylinder block 110, and a piston 130 is provided within an area defined by the cylinder liner 120. The cylinder liner 120 receives upward and downward force by friction generated by the rectilinear motion in the vertical direction of the piston 130. The cylinder liner 120 is designed to undergo minute movement in the vertical direction by the received force. As a result, the cylinder liner 120 is also referred to as a floating liner.

A device for measuring pressure generated by the vertical movement of the cylinder liner 120 is provided contacting the cylinder liner 120. An example of such a conventional device is shown in FIG. 1. In particular, provided to one side and at a lower-portion of the cylinder liner 120 is a load cell body 170 and a load cell 175.

A small space may result between a cylinder head 140 and an upper end of the cylinder liner 120. When fuel undergoes combustion in the combustion chamber, the explosive force acts in this space to displace the cylinder liner 120 in a downward direction (the explosive force is typically many hundred times greater than the force of friction between the cylinder liner 120 and the piston 130), thereby resulting in experimental error, that is inaccurate measurements of friction. Accordingly, a sealing folder 150 is interposed in the space between the cylinder head 140 and the upper end of the cylinder liner 120. The upper end of the cylinder liner 120 moves vertically within the sealing folder 150 such that the explosive force of combustion is prevented from acting on the cylinder liner 120.

However, in order to install the sealing folder 150 between the upper end of the cylinder liner 120 and the cylinder head 140, the piston 130 must be fabricated such that no contact occurs between the piston 130 and the sealing folder 150. That is, an outer edge of the piston 130 must be clearanced by as much as the sealing folder 150 protrudes into the combustion chamber. As a result, a moment of inertia of the piston 130 is altered such that the rectilinear motion of the piston 130 is also changed. This, in turn, modifies the contact resistance (i.e., friction) between the cylinder liner 120 and the piston 130 such that the precise measurement of friction between these elements cannot be performed.

Further, a lateral direction stopper 160 is used in the prior art to enable more precise measurements of friction between the cylinder liner 120 and the piston 130. The lateral direction stopper 160 acts to limit the side-to-side movement of the cylinder liner 120 by providing an opposing, lateral force thereto so that the friction generated is that of only the vertical motion of the piston 130. However, friction is generated between the lateral direction stopper 160 itself and the cylinder liner 120 by this opposing force in the lateral direction such that errors occur in the measurement of the friction between the piston 130 and the cylinder liner 120.

SUMMARY OF THE INVENTION

The present invention has been made in an effort to solve the above problems.

It is an object of the present invention to provide a liner mounting structure for measuring piston friction in which pressure forces acting on a liner are offset, and floating of the liner in a vertical direction is made easier.

To achieve the above object, the present invention provides a liner mounting structure for measuring piston friction in which a liner is mounted in a a cylinder block of an internal combustion engine and is cylindrically shaped to define a space in which a piston undergoes rectilinear motion, the liner mounting structure comprising a protrusion formed around an outer circumference of the liner at an upper portion of the liner; a combustion pressure passageway formed in the liner starting from an upper surface of the liner and extending downwardly to a bottom surface of the protrusion; an indentation formed in the cylinder block corresponding to a position of the protrusion of the liner; an upper O-ring groove formed in the cylinder block above the indentation, a lower O-ring groove formed in the cylinder block below the indentation, a center O-ring groove formed in the cylinder block within the indentation; and an upper O-ring mounted in the upper O-ring groove, a lower O-ring mounted in the lower O-ring groove, and a center O-ring mounted in the center O-ring groove.

According to a feature of the present invention, a plurality of the combustion pressure passageways are formed equidistantly starting from the upper surface of the liner.

According to another feature of the present invention, an area of a bottom surface of the protrusion is equal to an area of the upper surface of the liner.

According to yet another feature of the present invention, an area of an upper surface of the protrusion on which atmospheric pressure acts is equal to an area of a bottom surface of the liner.

According to still yet another feature of the present invention, a diameter of the center O-ring is equal to a sum of diameters of the upper and lower O-rings.

According to still yet another feature of the present invention, the liner mounting structure further comprises an atmospheric pressure passageway formed in the cylinder block between the upper O-ring groove and the center O-ring groove such that atmospheric pressure is provided in a space defined by the liner, the upper O-ring groove, the center O-ring groove and the cylinder block.

According to still yet another feature of the present invention, the liner mounting structure further comprises a lateral supporter mounted in the cylinder block, the lateral supporter preventing displacement of the liner in a lateral direction.

According to still yet another feature of the present invention, a plurality of lateral supporters is provided in the cylinder block.

According to still yet another feature of the present invention, the lateral supporter comprises a liner support member, an innermost face that is in close contact with the liner, and an outermost face that includes a plurality of support grooves, the liner support member being fixedly mounted encompassing an outer circumference of the liner; a cylinder block support member provided at a predetermined distance from the liner support member in a direction away from the liner, an outermost face of the cylinder block support member being in close contact with the cylinder block, and a plurality of support grooves being formed in an innermost face of the cylinder block support member; and a plurality of support plates inserted in a pair of corresponding support grooves of the liner support member and the cylinder block support member, the support plates being formed at a predetermined thickness.

According to still yet another feature of the present invention, the support plates are formed at identical thicknesses.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
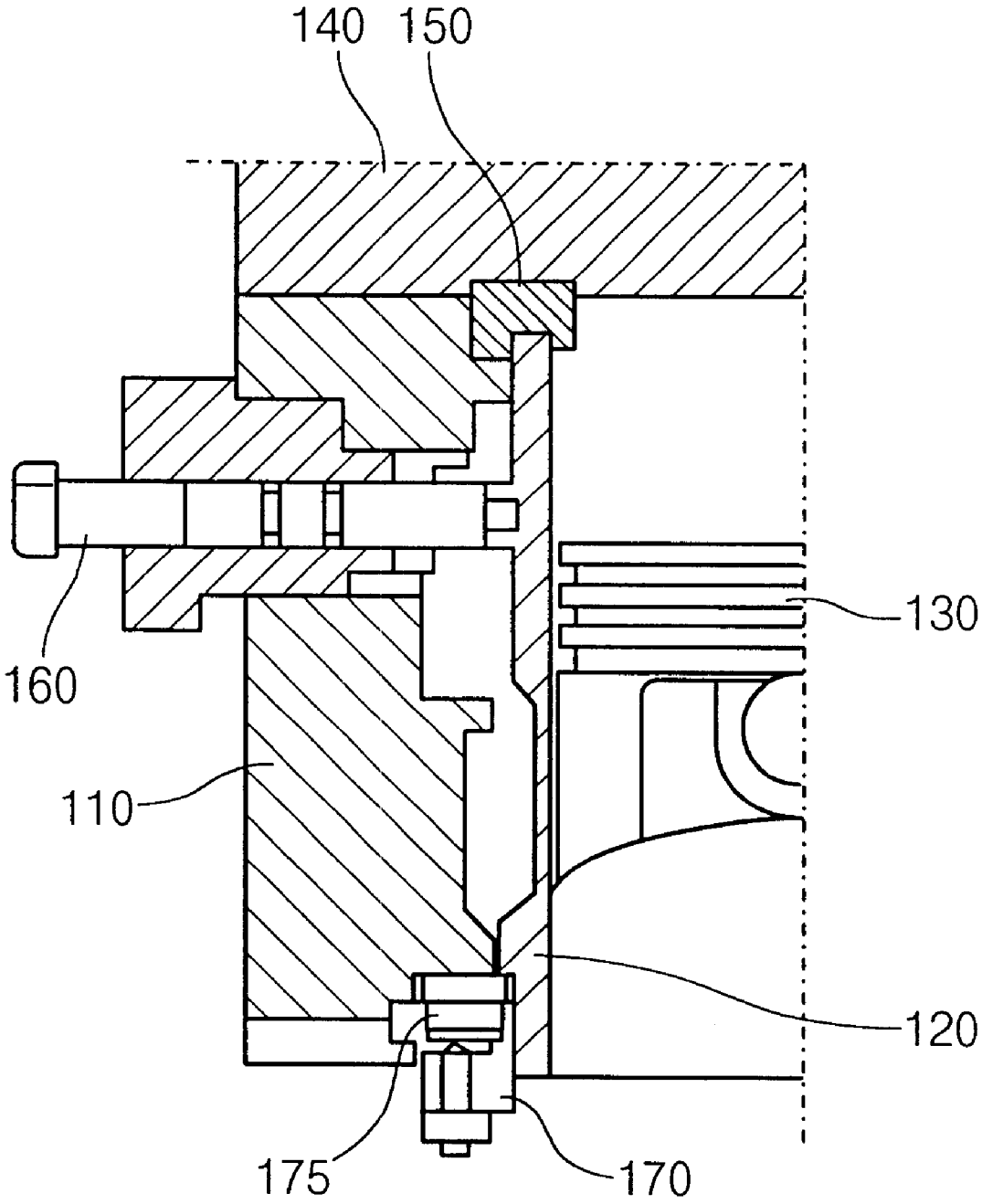
Fig. 1 Prior Art
FIG. 1 is a schematic sectional view of an example of a conventional apparatus and related elements used to measure friction between a piston and a cylinder liner.
Figure 2:
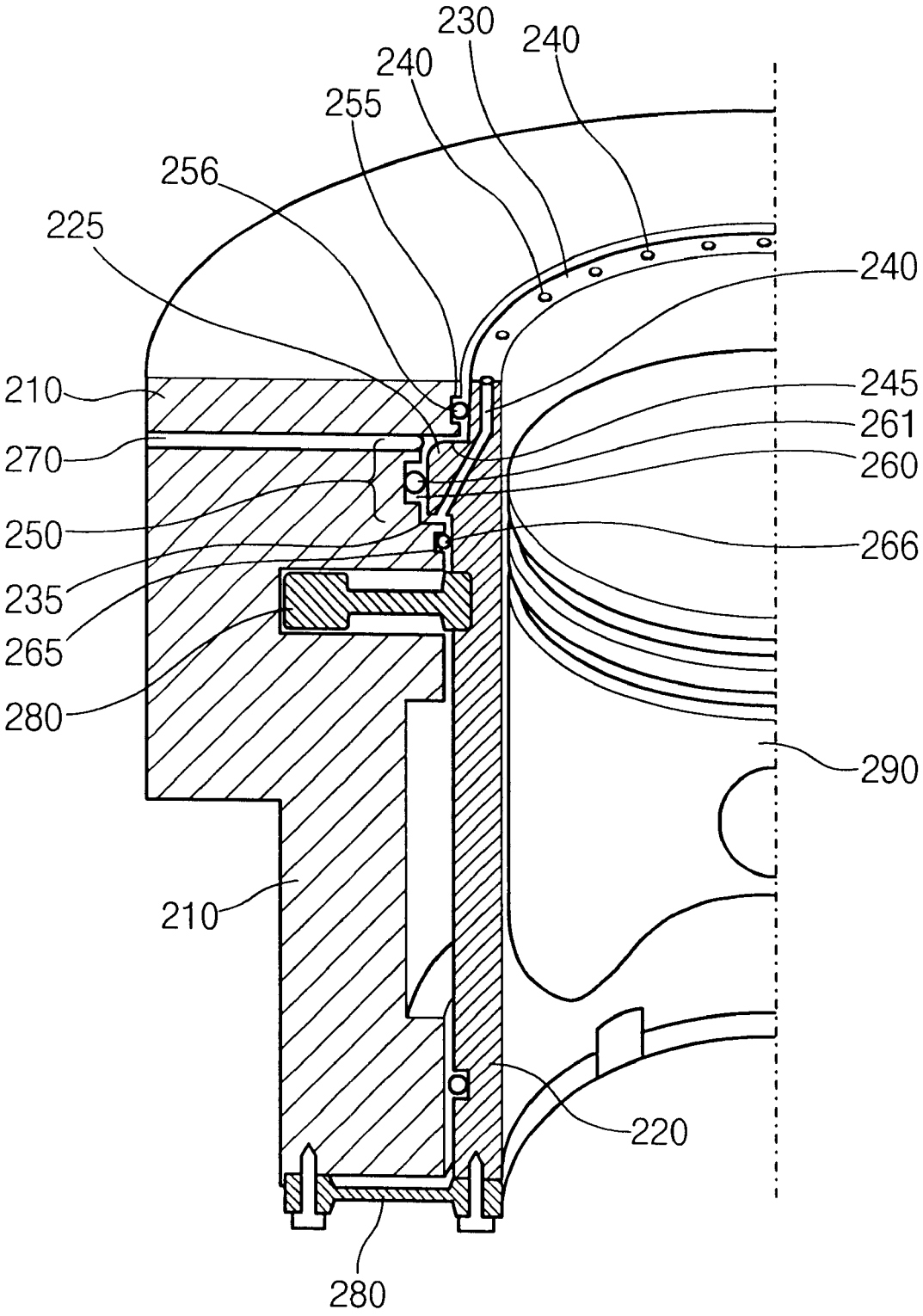
FIG. 2 is a schematic sectional view of a liner mounting structure for measuring piston friction and related elements according to a preferred embodiment of the present invention.

FIG. 2 shows a schematic sectional view of a liner mounting structure for measuring piston friction and related elements according to a preferred embodiment of the present invention.

A liner 220 is mounted within a cylinder block 210 of an internal combustion engine. The liner 220 is cylindrically shaped to define a space in which a piston 290 undergoes rectilinear motion. A protrusion 225 is formed around an outer circumference of the liner 220 at an upper portion thereof. Also, a plurality of combustion pressure passageways 240 are formed in the liner 220 starting from an upper surface 230 of the liner 220 and extending downwardly to a bottom surface 235 of the protrusion 225.

The cylinder block 210 includes an indentation 250, which is formed corresponding to a position of the protrusion 225 of the liner 220. An upper O-ring groove 255 is formed in the cylinder block 210 above the indentation 250, a lower O-ring groove 265 is formed in the cylinder block 210 below the indentation 250, and a center O-ring groove 260 is formed in the cylinder block 210 within the indentation 250. Provided in the O-ring grooves 255, 265 and 260 are an upper O-ring 256, a lower O-ring 266 and a center O-ring 261, respectively.

When explosive forces generated in the combustion chamber act on the upper surface of the liner 220, the resulting pressures are supplied to a space between the liner 220 and the cylinder block 210 under the indentation 250 through the combustion pressure passageways 240. It is preferable that a plurality of the combustion pressure passageways 240 is formed, and that the combustion pressure passageways 240 are formed symmetrically (i.e., equidistant to each other) around the upper surface 230 of the liner 220.

An atmospheric pressure passageway 270 is formed in the cylinder block 210 between the upper O-ring groove 255 and the center O-ring groove 260. That is, the atmospheric pressure passageway 270 extends from an outer surface of the cylinder block 210 to the indentation 250 at a location between the upper O-ring groove 255 and the center O-ring groove 260. It is preferable that a plurality of atmospheric pressure passageways 270 is provided in the cylinder block 210.

In the liner mounting structure of the present invention as described above, an area of the bottom surface 235 of the protrusion 225 of the liner 220 is identical to an area of the upper surface 230 of the liner 220, and an area of the upper surface 245 of the protrusion 225 of the liner 220 is identical to an area of a bottom surface of the liner 220 on which atmospheric pressure acts. Accordingly, each pressure force acting on the liner 220 is offset by a force in the opposite direction and equal in magnitude as a result of acting on an identical surface area. Further, a diameter of the center O-ring 261 is equal to the sum of diameters of the upper O-ring 256 and the lower O-ring 266. This configuration also enables the offsetting of pressure forces as will be described below.

Figure 3:
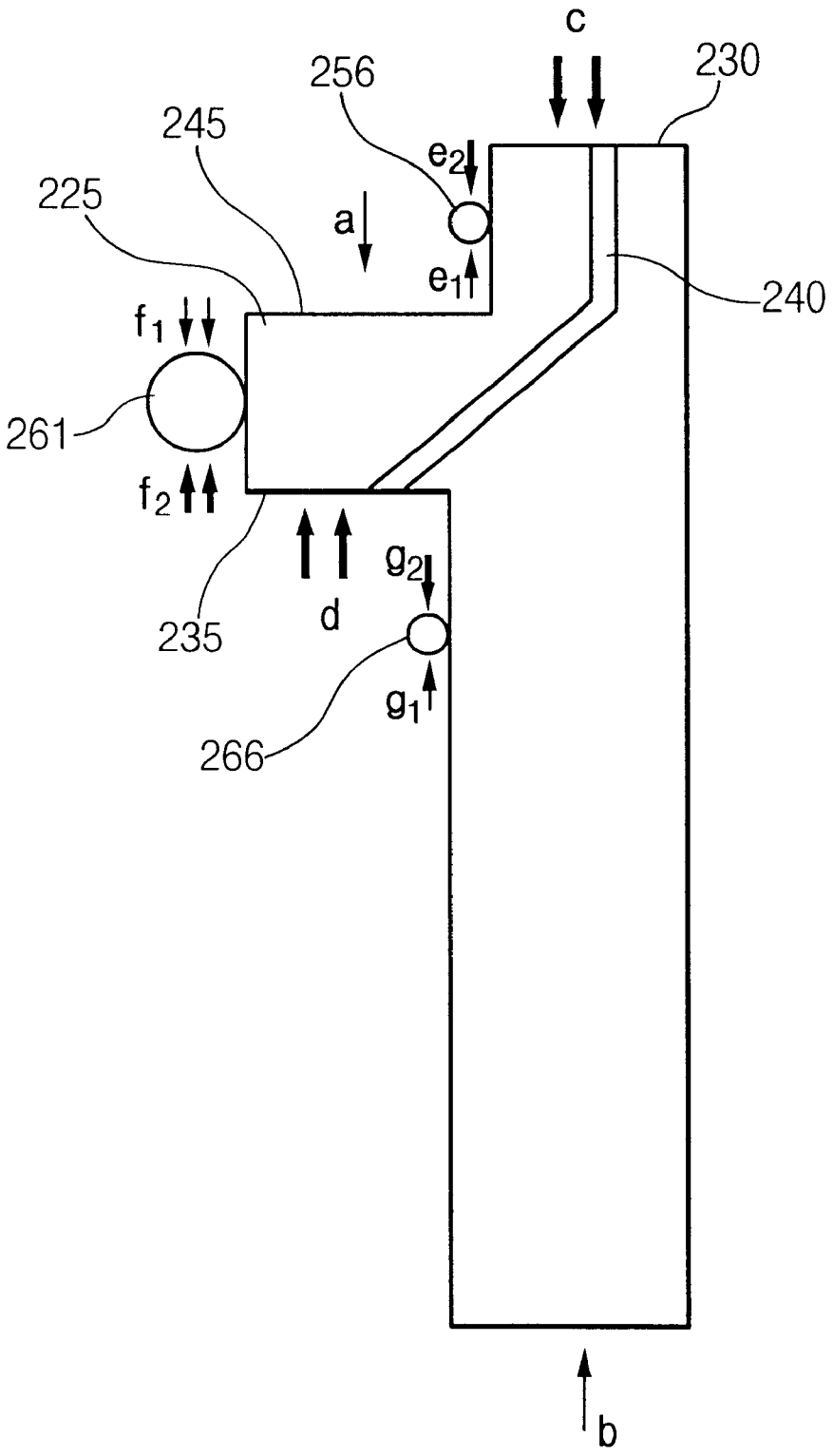
FIG. 3 is a partial sectional view of the liner of FIG. 2 and forces acting on the liner.

FIG. 3 shows a partial sectional view of the liner 220 and forces acting on the liner 220.

As shown in the drawing, when combustion pressure acts on the upper surface 230 of the liner 220, the combustion force is supplied to the bottom surface 235 of the protrusion 225 through the combustion pressure passageway 240. However, since the area of the upper surface 230 of the liner 220 and that of the bottom surface 235 of the protrusion 225 are identical, a descending force (c) resulting from the combustion pressure acting on the upper surface 230 of the liner 220 and an ascending force -(d) acting on the bottom surface 235 of the protrusion 225 are offset.

Further, the atmospheric pressure supplied through the atmospheric pressure passageway 270 (FIG. 2) acts as a descending force (a), and the descending force (a) is offset by an ascending force (b) of the atmospheric pressure acting on the bottom surface of the liner 220, which has the same area as the upper surface 245 of the protrusion 225.

In addition, atmospheric and combustion pressures acting on the O-rings 256, 266 and 261 are also offset. That is, with respect to the upper O-ring 256, combustion pressure passing over the upper surface 230 of the liner 220 acts at a magnitude e2 on an upper side of the upper O-ring 256, while the atmospheric pressure acting on a lower side of the upper O-ring 256 acts at a magnitude e1. Further, with respect to the lower O-ring 266, the combustion pressure passing through the combustion pressure passageway 240 acts at a magnitude g2 on an upper side of the lower O-ring 266, while the atmospheric pressure acting on a lower side of the lower O-ring 266 acts at a magnitude g1. Finally, with respect to the center O-ring 261, the atmospheric pressure acts at magnitude f1 on an upper side of the center O-ring 261, while the combustion pressure passing through the combustion pressure passageway 240 acts at a magnitude f2 on a lower side of the center O-ring 261.

Since, as described with reference to FIG. 2, the diameter of the center O-ring 261 is equal to the sum of the diameters of the upper O-ring 256 and the lower O-ring 266, the magnitudes e2 and g2 of the pressure forces acting downwardly on the upper O-ring 256 and the lower O-ring 266, respectively, are equal to the magnitude f2 of the pressure force acting upwardly on the center O-ring 261. Likewise, the magnitudes e1 and g1 of the pressure forces acting upwardly on the upper O-ring 256 and the lower O-ring 266, respectively, are equal to the magnitude f1 of the pressure force acting downwardly on the center O-ring 261. Hence, the atmospheric and combustion pressures acting on the O-rings 256, 266 and 261 are offset.

Accordingly, with the liner mounting structure as described above, the offsetting of all the pressure forces enables accurate measurements of friction between the piston 290 and the liner 220.

Further, a lateral supporter 280 is provided in the cylinder block 210. The lateral supporter 280 is provided in close contact with the liner 220 and acts to prevent movement of the liner 220 in a lateral direction. It is preferable that a plurality of lateral supporters 280 is mounted in the cylinder block 210.

Figure 4:
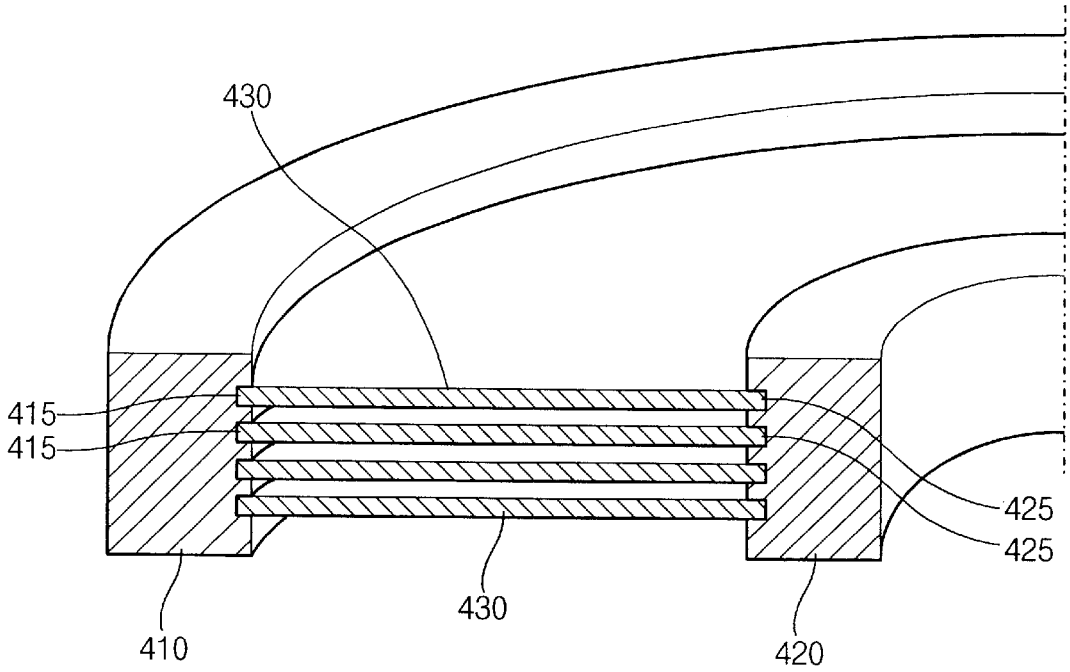
FIG. 4 is a partial sectional view of a lateral supporter of FIG. 2.

FIG. 4 shows a partial sectional view of the lateral supporter 280.

With reference to FIGS. 2 and 4, the lateral supporter 280 includes a liner support member 420 that is fixed to the liner 220, and a leftmost face (in the drawing) of which includes a plurality of support grooves 425. The liner support member 420 is formed at a predetermined height and is fixedly mounted encompassing an outer circumference of the liner 220.

Provided at a predetermined distance from the liner support member 420 in a direction away from the liner 220 is a cylinder block support member 410. The cylinder block support member 410 is fixed to the cylinder block 210, and a plurality of support grooves 415 is formed in a rightmost face (in the drawing) of the cylinder block support member 410. Each support groove 415 of the cylinder block support member 410 corresponds to a support groove 425 of the liner support member 420, and a support plate 430 is inserted in a pair of corresponding support grooves 415 and 425. The support plates 430 are formed at uniform thicknesses.

If the above configuration having a plurality of the support plates 430 is compared with a structure in which there is provided a single support plate having a thickness equal to that the multiple support plates 430 combined, although a substantially identical supporting force in the lateral direction is realized, the supporting force in the vertical direction is reduced substantially.

This is a result of the supporting force provided in the vertical direction having an exponential relation (i.e., cubed) to the thickness of the support plate, while the supporting force in the lateral direction is related to the thickness of the support by a factor of less than two. Therefore, the supporting force in either case is the same in the lateral direction. However, the supporting force in the vertical direction is reduced when a plurality of the support plates 430 of a total thickness equal to a single support plate is used.

Hence, the lateral supporter 280 enables relatively easy floating of the liner 220 in the vertical direction such that precise measurements of piston friction may be obtained.

In the liner mounting structure for measuring piston friction of the present invention, the influence of combustion pressure acting on a liner is removed and floating of the liner is made easy. Accordingly, accurate measurements of piston friction may be obtained.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liner mounting structure for measuring piston friction in which a liner is mounted in a cylinder block of an internal combustion engine and is cylindrically shaped to define a space in which a piston undergoes rectilinear motion, the liner mounting structure comprising:

a protrusion formed around an outer circumference of the liner at an upper portion of the liner;

a combustion pressure passageway formed in the liner starting from an upper surface of the liner and extending downwardly to a bottom surface of the protrusion;

an indentation formed in the cylinder block corresponding to a position of the protrusion of the liner;

an upper O-ring groove formed in the cylinder block above the indentation, a lower O-ring groove formed in the cylinder block below the indentation, and a center O-ring groove formed in the cylinder block within the indentation; and an upper O-ring mounted in the upper O-ring groove, a lower O-ring mounted in the lower O-ring groove, and a center O-ring mounted in the center O-ring groove.

2. The liner mounting structure of claim 1 wherein a plurality of the combustion pressure passageways are formed equidistantly starting from the upper surface of the liner.

3. The liner mounting structure of claim 2 wherein an area of a bottom surface of the protrusion is equal to an area of the upper surface of the liner.

4. The liner mounting structure of claim 3 wherein an area of an upper surface of the protrusion, on which atmospheric pressure acts, is equal to an area of a bottom surface of the liner.

5. The liner mounting structure of claim 4 wherein a diameter of the center O-ring is equal to a sum of diameters of the upper and lower O-rings.

6. The liner mounting structure as in claim 1 further comprising an atmospheric pressure passageway formed in the cylinder block between the upper O-ring groove and the center O-ring groove such that atmospheric pressure is provided in a space defined by the liner, the upper O-ring groove, the center O-ring groove and the cylinder block.

7. The liner mounting structure of claim 6 further comprising a lateral supporter mounted in the cylinder block, the lateral supporter preventing displacement of the liner in a lateral direction.

8. The liner mounting structure of claim 7 wherein a plurality of lateral supporters are provided in the cylinder block.

9. The liner mounting structure of claim 7 wherein the lateral supporter comprises:

a liner support member, an innermost face that is in close contact with the liner, and an outermost face that includes a plurality of support grooves, the liner support member being fixedly mounted encompassing an outer circumference of the liner;

a cylinder block support member provided at a predetermined distance from the liner support member in a direction away from the liner, an outermost face of the cylinder block support member being in close contact with the cylinder block, and a plurality of support grooves being formed in an innermost face of the cylinder block support member; and a plurality of support plates inserted in a pair of corresponding support grooves of the liner support member and the cylinder block support member, the support plates being formed at a predetermined thickness.

10. The liner mounting structure of claim 9 wherein the support plates are formed of identical thicknesses.

* * * * *